United States Patent [19]

Skowasch et al.

[11] Patent Number: 5,046,424

[45] Date of Patent: Sep. 10, 1991

[54] FUZE FOR A BOMBLET PROJECTILE

[75] Inventors: Gerhard Skowasch, Gelsenkirchen; Wolfgang Hoffmann, Velbert, both of Fed. Rep. of Germany

[73] Assignee: Rheinmetall GmbH, Düsselforf, Fed. Rep. of Germany

[21] Appl. No.: 559,350

[22] Filed: Jul. 30, 1990

[30] Foreign Application Priority Data

Jul. 29, 1989 [DE] Fed. Rep. of Germany ..... 3925236

[51] Int. Cl.[5] ..... F42B 12/58; F42C 9/14; F42C 15/184; F42C 15/22

[52] U.S. Cl. ..... 102/226; 102/245; 102/269; 102/393

[58] Field of Search ..... 102/226, 227, 228, 229, 102/269, 489, 242, 393, 245, 385, 386, 388

[56] References Cited

U.S. PATENT DOCUMENTS

| | | | |
|---|---|---|---|
| 3,838,644 | 10/1974 | Prochnow et al. | 102/475 |
| 3,913,483 | 10/1975 | Wolterman | 102/226 |
| 3,998,164 | 12/1976 | Hedfield | 102/226 |
| 4,004,514 | 1/1977 | Daniels | 102/385 |
| 4,455,940 | 6/1984 | Furuike | 102/228 |
| 4,653,401 | 3/1987 | Gatti | 102/489 |
| 4,715,282 | 12/1987 | Rosenberg et al. | 102/227 |
| 4,762,066 | 8/1988 | Rüdenauer et al. | 102/393 |
| 4,777,879 | 10/1988 | Bueno et al. | 102/230 |
| 4,873,927 | 10/1989 | Rüdenauer | 102/226 |

FOREIGN PATENT DOCUMENTS 2242930 3/1972 Fed. Rep. of Germany .

*Primary Examiner*—David H. Brown
*Attorney, Agent, or Firm*—Spencer & Frank

[57] ABSTRACT

A fuze for a bomblet projectile, with the fuze being of the type including a fuze housing, an axially displaceable firing pin mounted in the housing, a slide carrying a detonation charge mounted in the housing and displaceable transverse to the longitudinal direction of the housing between a safety position and an armed position, and spin braking fins pivotally mounted on the exterior of the fuze housing. To provide a further safety measure for the bomblet fuze and to ensure pendulum-free spin braking for safe detonation, the slide is provided with a safety pin and the fuze housing is provided with a corresponding opening such that the safety pin is in operative connection adjacent the opening with a spin braking fin if the latter is not deployed, and thus the slide can be arrested in its safety position. At least two spin braking fins are mounted on holding pins on the fuze housing so that the spin braking fins are pivotal transversely to the longitudinal axis of the projectile and in a direction opposite to the direction of the flow of air caused by spin of the projectile.

11 Claims, 3 Drawing Sheets

A
36
30

32
10
32
II
II
26
34
38
20
62
36
34
10
64
42
54
60
52
14
12
40
18
16
28
22
56
58
24
29

FUZE FOR A BOMBLET PROJECTILE

REFERENCE TO RELATED APPLICATIONS

This application relates to and incorporated herein by reference, concurrently filed U.S. Pat. application Nos. 27/558,346 and 07/559,936, corresponding respectively to Federal Republic of Germany applications P 39 25 235.3 and P 39 25 238.8, both filed July 29th, 1989.

This application further claims the priority of Federal Republic of Germany application Serial No. P 39 25 236.1 filed July 29th, 1989.

BACKGROUND OF THE INVENTION

The present invention relates to a fuze for a bomblet projectile, with the fuze including an axially displaceable firing pin, a slide which carries a detonation charge and which is displaceable transversely to the longitudinal direction of the projectile, and to the projectile and fuze housing center axis, to move the detonation charge from a safety position to a position wherein it is aligned with the firing pin, and spin braking fins which are pivotally mounted on the exterior of the fuze housing.

Bomblet projectiles are submunition projectiles, that is, secondary projectiles, which are transported in large numbers, e.g. 63 each, by a large-caliber carrier projectile over distances up to 30 km to above a target area and are there ejected at a height of, for example, 300 m. While such bomblet projectiles are dropping or descending, they are mechanically set to detonate.

In order to ensure high penetration power for the shaped charge of the bomblet, it is necessary to quickly brake, in a defined manner, the high rotational velocity of the bomblet after it is ejected from the carrier projectile without the bomblet taking on or passing through an unstable flight position.

Federal Republic of Germany Laid-open patent application DE-OS 2,242,930, corresponding to U.S. Pat. No. 3,838,644, already discloses a stackable bomblet whose spin braking fins are deployed, by centrifugal force, transversely to the longitudinal axis of the projectile and are pressed by the on-flowing air against a projection on the housing serving as a fixed abutment. The drawback here is that the braking effect already begins with full force immediately after ejection, and the sudden stopping of the spin braking fins when they are deployed may initiate or augment a pendulum action of the bomblet with the result that the fuze may fail upon impact.

This prior art bomblet fuze is made in the following manner: The bomblet fuze includes a firing pin provided with a screw mechanism which is screwed in when the safety is on and thus engages in a recess in the detonator carrier or slide to prevent it from being transversely displaced into the armed position. The outer end piece of the screwed-in firing pin facing away from the detonator carrier is connected with a stabilization loop which unfolds after ejection of the bomblet from the carrier projectile and, due to the onset of air resistance, exerts a torque on the screwed-in firing pin. After the firing pin has been unscrewed sufficiently, centrifugal forces push the detonator carrier into its armed position and the safety is off the fuze, arming it. There now exists the possibility that during contact of a different bomblet with the screwed-out firing pin, premature detonation in the air may take place.

SUMMARY OF THE INVENTION

It is an object of the present invention to provide increased operational safety for a bomblet fuze under identical conditions for arming it, with a further safety means being provided which ensures a malfunction-free sequence of steps for the successively occurring safety release operations.

The above object is achieved according to the present invention by a fuze for a bomblet projectile of the type including a fuze housing, a firing pin mounted for axial displacement in the housing, a detonation charge mounted on a slide disposed within the housing for displacement in a direction transverse to the longitudinal direction of the housing (and its center axis) between a safety position (wherein the detonation charge is not aligned with the firing pin) and an armed position (wherein the detonation charge is aligned with the firing pin), and a plurality of spin braking fins pivotally mounted to the exterior of the fuze housing for movement between a non-deployed position (wherein the fins are disposed adjacent to an exterior surface of the housing) and a deployed position (wherein the fins extend transversely to the center axis); and wherein: an opening is provided in the side wall of the fuze housing; and a safety pin is mounted on the slide for movement therewith such that the safety pin takes on a position within the fuze housing when the slide is in the safety position, and passes, at least in part, through the opening to take on a final position which, at least in part, is outside of the fuze housing after displacement of the slide to the armed position.

In the safety position of the slide, the safety pin, which preferably extends parallel to the longitudinal direction of the projectile fuze housing and its said center axis, is in operative engagement with one of the non-deployed spin braking fins so that the slide is arrested in the safety position until the braking fin has been deployed, at least partially.

By arranging the safety pin on the slide so that it is prevented from being displaced and is arrested by the not yet deployed spin braking fins, an additional safety is provided for the bomblet fuze in a simple but effective manner which is independent of the safety releasing process of the firing pin. To accomplish this, a holding tab is disposed on the interior of a spin braking fin so as to hold the slide in the safety position when the spin braking fins are folded inwardly. Only after the spin braking fin has exceeded an opening angle of at least 15° is the safety pin, and thus the slide, released. However, the spin braking fin is able to perform this deployment process only if it, in turn, has been released by an outer safety band, and this can happen only after ejection from the carrier projectile. Consequently, independently of the torque acting on the stabilization band and the period of time during which the firing pin is unscrewed, there exists a further safety for the slide.

Since the spin braking fins have no fixed abutment at the housing, but pivot outwardly in a yielding manner adapted to, and a function of, the rotation of the bomblet and the centrifugal force as well as the counteracting on-flowing air so as to "softly" but effectively brake the inherent spin of the bomblet, the bomblet is not subjected to pendulum action as a result of the sudden unfolding of the spin braking fins as was customary in the past. This reduces the number of bomblets which, upon impact, are still positioned at such an angle that the impact function fails because the component of the impact pulse acting in the direction of the axis of the firing pin is too small.

The invention will be described below in greater detail with reference to an embodiment thereof that is illustrated in the drawing figures.

DETAILED DESCRIPTION OF THE PREFERRED EMBODIMENTS

Figure 1:
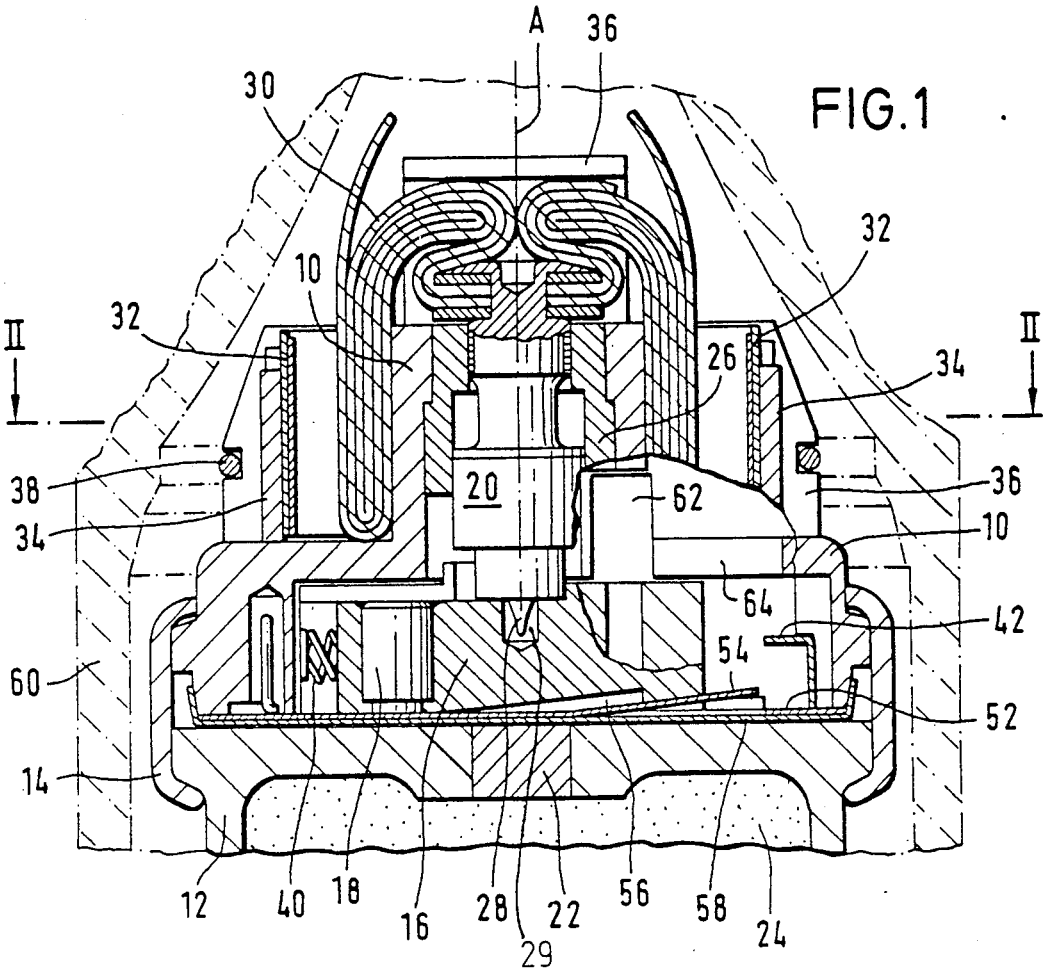
FIG. 1 is a longitudinal sectional view of a bomblet fuze housing according to the invention.

Referring now to FIG. 1, there is shown a fuze housing 10, having a lower larger diameter region and an upper smaller diameter region, which is firmly fixed by means of a holding ring 14 on a bomblet housing 12. Within the lower larger diameter region or portion of fuze housing 10, there is disposed a slide 16 which contains a detonator charge 18 and which is displaceable transversely to the longitudinal or center axis A of the bomblet projectile, and thus of the fuze housing 10.

The illustration shows slide 16 in the safety position in which the detonator charge 18 is displaced laterally out of the straight line between a primary firing pin 20 disposed in the fuze housing 10 and a booster charge 22 disposed in the upper bomblet housing 12 to detonate the primary explosive charge 24. In a known manner, the centrally disposed primary firing pin 20 is connected via a screw connection with a casing 26 which serves as an additional striking mass and which is axially displaceable within the fuze housing 10. In the illustrated safety position, firing pin 20 is screwed into casing 26 so that the pin is supported upwardly and rearwardly against a housing projection in fuze housing 10. At the front, tip 28 of primary firing pin 20 projects into a recess (blind bore) 29 disposed on the upper surface of the slide 16, and thus fixes slide 16 in the safety position.

A folded-together stabilization loop 30 is fastened to the end of primary firing pin 20 projecting from fuze housing 10. On the exterior of fuze housing 10, and enclosing the upper, smaller diameter region of fuze housing 10, two radially outwardly pivotal spin braking fins 32 are each fastened to a respective longitudinally extending holding pin 66. These fins 32 are made, for example, of a thin steel sheet and are bent in the form of a semicircle. A safety band 34 is wound around the folded-in spin braking fins 32.

In their wound position, safety band 34 and stabilization loop 30 are held by a hood-like, two-part plastic safety shell 36 which is pushed over them and which, in turn, is held in its position by a spring steel safety ring 38.

During transport into a target area by means of a large-caliber carrier projectile which can be fired over large distances, for example 30 km, the secondary projectiles (bomblets) are stacked within the carrier projectile in the form of space saving columns. FIG. 1 shows, in dashed lines, such an adjacent bomblet 60 which completely covers fuze housing 10. Fuze housing 10 projects far into the conical free space provided by the shaped charge liner of the adjacent bomblet 60.

When the bomblet projectiles are ejected from the carrier projectile over the target area by means of an ejection charge and the stack arrangement no longer exists, several steps take place in timely succession within a predetermined period of time from the bomblet fuze being in the safety position until it is set to detonate.

Initially, stabilization loop 30 on the exterior is pulled out of its folded-in rest position and unfolded, and at the same time, the two safety shells 36 and safety ring 38 are released from fuze housing 10 and release safety band 34. Then the discardable safety band 34 is unwound and releases the spin braking fins 32 which, due to the centrifugal forces caused by rotation, pivot outwardly and reduce the spin of the bomblet projectile which now drops in a stabilized manner.

Once stabilization loop 30 has been unfolded, a torque acts on firing pin 20 causing it to be screwed somewhat toward the rear, out of casing 26. This causes the tip 28 of firing pin 20 to come out of the recess 29 in the upper surface of slide 16 so that the slide 16 is able to be displaced laterally, if further separately acting safety arrangements likewise have been released, into its armed position with the detonator 18 aligned with the firing pin 20, so that the fuze is set to detonate upon impact.

Additionally disposed in the fuze housing 10 in the path of movement of the slide 16 is a further or second firing pin 42 which, when the slide 16 has reached the armed position, ignites an arrangement (not shown) disposed in slide 16 which will cause the detonator charge 18 to be activated after a given time delay. This acts as a safety measure to destroy the projectile if, by the end of the given time delay, the primary firing pin 20 has not activated the charge 18 due to impact with an object, e.g. due to falling on very soft ground or in deep snow. The second firing pin 42 is formed as a bent portion of a sheet metal disc 52 disposed in the bottom of the housing 10 adjacent the bottom of the slide 16 and is held in housing 10 by means of a sheet metal hood or cover 58 which engages the exterior surface of the housing 10. The disc 52 is likewise provided with an upwardly extending spring tab 54 which engages in a recess 56 formed in the bottom surface of the slide 16 when the slide has moved to the armed position and thus arrest further movement of the slide 16.

Figure 2:
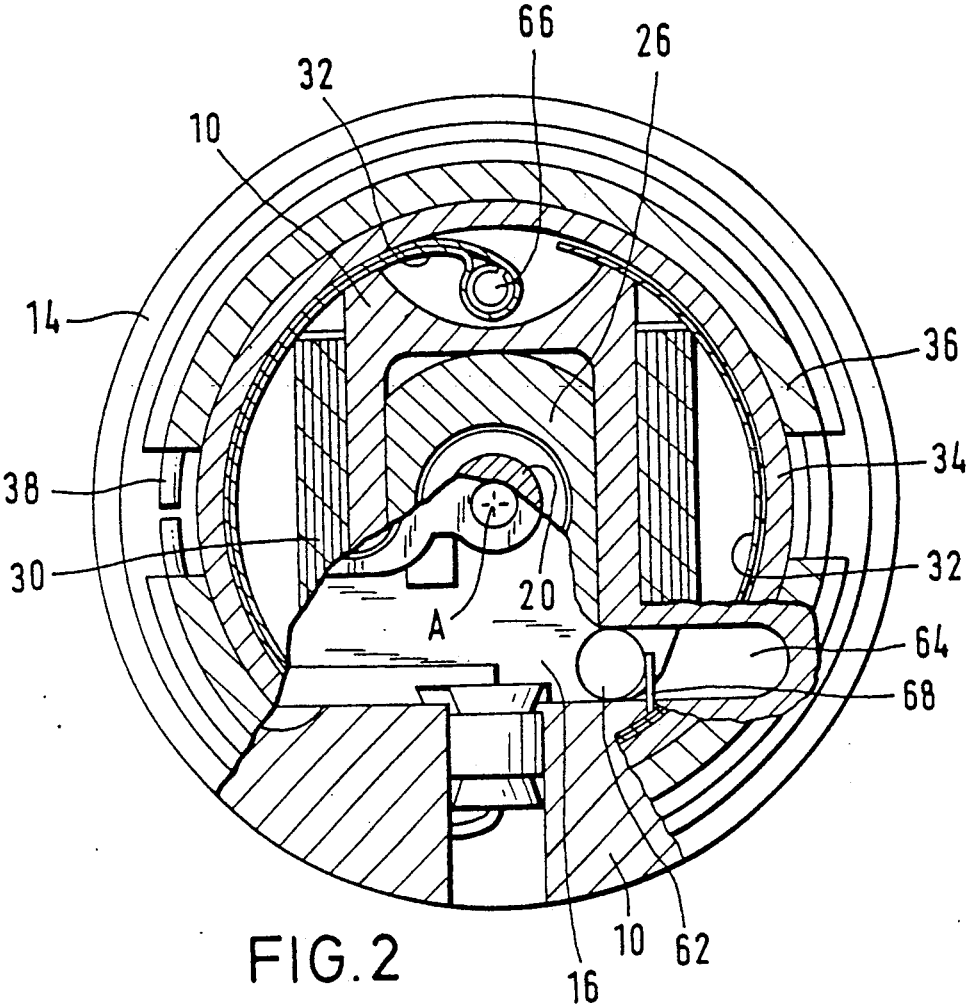
FIG. 2 is a cross-sectional view of the fuze housing at the height of the spin braking fins with a partially cut-open slide seen along line II—II of FIG. 1.

FIG. 2 shows the operation of the second safety device according to the invention. A safety pin 62 is arranged on the upper surface of the slide 16 so as to extend parallel to the center axis A. Fuze housing 10 is provided with a corresponding opening 64 for the safety pin 62 which is disposed on the slide 16 so that the pin 62 can take up a position within the fuze housing 10 adjacent a portion of the opening 64 in the side wall of the upper smaller diameter region of the housing 10 when the slide 16 is in the safety position (as shown in FIGS. 1 and 2), and an end position outside of fuze housing 10 once slide 16 has been pushed laterally into the armed position for the fuze. In the safety position, safety pin 62 is in operative connection with a non-deployed spin braking fin 32 so that slide 16 can be arrested in its safety position.

Advisably, as shown in FIG. 2, spin braking fin 32 is provided with an inwardly oriented projection 68 which, when spin braking fins 32 are not deployed, is in contact at the opening 64 with the safety pin 62 and grips it so as to block and arrest lateral amount of the pin 62, and thus slide 16. In FIG. 2, slide 16 is still in the safety position and both mutually independent safety arrangements, i.e. the screwed-in primary firing pin 20 and the safety pin 62 arrested by the projection 68 on the interior of the still undeployed spin braking fin 32, are effective.

Figure 3:
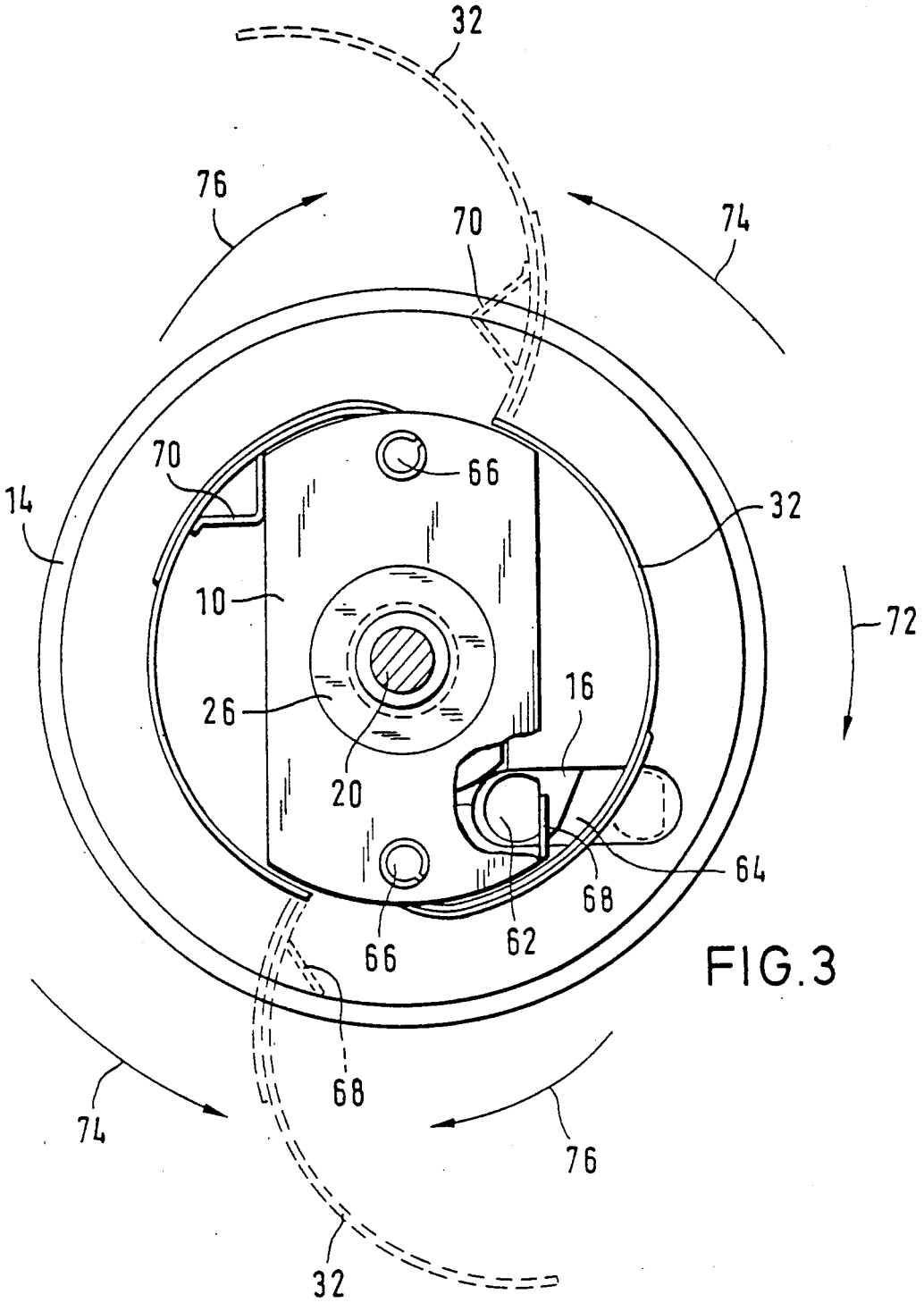
FIG. 3 is a top view of the fuze housing with an illustration of the spin braking fins.

FIG. 3 is a top view of fuze housing 10 with the safety band 34, the stabilization loop 30 and safety clamp 36 having been omitted for the sake of clarify and additionally showing, in dashed lines, the deployed spin braking fins 32.

According to a feature of the present invention, at least two spin braking fins 32 are mounted on respective holding pins 66 in fuze housing 10 so as to be pivotal to a position oriented transversely to the longitudinal axis of the projectile and to center axis A, and with mounting being such that the direction of pivotal movement is clockwise if the bomblet projectile is fired with a clockwise spin (as illustrated), or counterclockwise if the bomblet projectile is fired with a counterclockwise spin. That is, the fins are mounted in the direction of pivotal movement is against the flow of air 74 generated by the rotation. This produces a strong but jerk-free, soft braking of the inherent rotation of the bomblet projectile. In FIG. 3, the direction of rotation 72 of the bomblet projectile, the direction of air flow 74 and the oppositely directed deploying direction 76 of the spin braking fins 32 are indicated by respective arrows.

For reasons of strength, it may be advisable to configure the projection 68 on the interior of spin braking fins 32 as an angled bar 70 which is fastened at both ends. In order to ensure that safety pin 62 and slide 16 remain arrested even if they are loosened, for example, due to environmental conditions, it is provided that the lock of safety pin 62 and slide 16 can be released only after the spin braking fin 32 and its projections 68 or 70, respectively, have been pivoted about an angle of at least 15°.

If firing pin 20 has been screwed out of the blind bore 29 in slide 16 and safety pin 62 has been released by the deployed spin braking fin 32, slide 16 is able to be displaced to the armed position by centrifugal forces and/or by spring forces provided by a compressed spring 40 disposed in housing 10. Then safety pin 62 is shown in the position shown in dashed lines outside of fuze housing 10. If a bomblet projectile should, for example, land very softly, for example, in deep snow, and the impact fuze should fail or the fuze fails to ignite and thus to detonate, the position of safety pin 62 very advantageously gives a visual indication of the state of the bomblet fuze so that an evaluation of its status and the safety of the surroundings can be made.

The invention now being fully described, it will be apparent to one of ordinary skill in the art that any changes and modifications can be made thereto without departing from the spirit or scope of the invention as set forth herein.

What is claimed is:

1. In a fuze for a bomblet projectile including: a fuze housing; a firing pin mounted for axial displacement in said housing; a detonation charge mounted on a slide disposed within said housing for displacement in a direction transverse to the longitudinal direction of the housing and its center axis between a safety position, wherein said detonation charge is not aligned with said firing pin, and an armed position, wherein said detonation charge is aligned with said firing pin; and a plurality of spin braking fins pivotally mounted to the exterior of said fuze housing for movement between a non-deployed position, wherein said fins are disposed adjacent to an exterior surface of said housing, and a deployed position, wherein said fins extend transversely to said center axis; the improvement comprising: an opening provided in said side wall of said fuze housing; and a safety pin mounted on said slide for movement therewith such that said safety pin takes on a position within said fuze housing when said slide is in said safety position and passes, at least in part, through said opening to take on a final position which, at least in part, is outside of said fuze housing after displacement of said slide to said armed position.

2. A fuze as defined in claim 1 wherein with said slide in said safety position and said spin braking fins in a non-deployed position, said safety pin is in operative engagement with one of said non-deployed spin braking fins, whereby said slide is arrested in said safety position.

3. A fuze as defined in claim 2 wherein at least two of said spin braking fins are mounted on said fuze housing so as to pivot in a direction opposite to the direction of air flow generated by spin imparted to the fuze to a position extending traverse to the longitudinal axis of said fuze housing.

4. A fuze as defined in claim 3 wherein said one spin braking fin is provided with an inwardly oriented projection which, when said one spin braking fin is in the non-deployed state, is in contact with said safety pin adjacent said opening to arrest and block said pin against movement toward said armed position of said slide.

5. A fuze as defined in claim 1 wherein said safety pin extends parallel to said longitudinal direction of said projectile fuze housing and its said center axis.

6. A fuze as defined in claim 5 wherein: said housing has a first portion having a given diameter and in which said slide is mounted for movement, and a second portion having a diameter smaller than said given diameter of said first portion; and at least a portion of said opening is an elongated slot extending parallel to said center axes and disposed in the side wall of said second portion of said housing.

7. A fuze as defined in claim 5 wherein with said slide in said safety position and said spin braking fins in a non-deployed position, said safety pin is in operative engagement with one of said non-deployed spin braking fins, whereby said slide is arrested in said safety position.

8. A fuze as defined in claim 7 wherein at least two of said spin braking fins are mounted on said fuze housing so as to pivot in a direction opposite to the direction of air flow generated by spin imparted to the fuze to a position extending traverse to the longitudinal axis of said fuze housing.

9. A fuze as defined in claim 7 wherein said one spin braking fin is provided with an inwardly oriented projection which, when said one spin braking fin is in the non-deployed state, is in contact with said safety pin adjacent said opening to arrest and block said pin against movement toward said armed position of said slide.

10. A fuze as defined in claim 9 wherein said projection is configured as an angled bar which is fastened at both ends to an interior surface of said one spin braking fin.

11. A fuze as defined in claim 9 wherein said projection is shaped and disposed on said one fin such that the blocking of said safety pin, and thus of said slide, is released only after said one spin braking fin and its said projection have been pivoted about an angle of at least 15°.

* * * * *